US005561997A

United States Patent [19]

Milman

[11] Patent Number: 5,561,997

[45] Date of Patent: Oct. 8, 1996

[54] ELECTROMAGNETIC LOCK FOR CYLINDRICAL LOCK BARREL

[75] Inventor: Sheldon Milman, Wheeling, Ill.

[73] Assignee: Marlok Company, Chicago, Ill.

[21] Appl. No.: 426,429

[22] Filed: Apr. 20, 1995

Related U.S. Application Data

[63] Continuation of Ser. No. 14,971, Feb. 8, 1993, abandoned.

[51] Int. Cl.[6] ..... E05B 47/06

[52] U.S. Cl. ..... 70/283; 70/421; 70/DIG. 62; 70/277

[58] Field of Search ..... 70/276, DIG. 62, 70/419, 421, 277, 278, 283

[56] References Cited

U.S. PATENT DOCUMENTS

| | | | |
|---|---|---|---|
| 1,173,677 | 2/1916 | Müller | 70/421 |
| 1,979,939 | 11/1934 | Jacobi | 70/376 |
| 3,495,425 | 2/1970 | Hallmann | 70/276 |
| 3,670,538 | 6/1972 | Curry | 70/277 |
| 3,857,263 | 12/1974 | Gartner | 70/421 |
| 3,942,345 | 3/1976 | Sasahara | 70/276 |
| 4,026,134 | 5/1977 | Woolfson | 70/276 |
| 4,333,327 | 6/1982 | Wake | 70/276 |
| 4,444,034 | 4/1984 | Best et al. | 70/369 |
| 4,489,359 | 12/1984 | Suzuki | 361/172 |
| 4,771,620 | 9/1988 | Kleinhäny | 70/277 |
| 4,807,454 | 2/1989 | Sengupta et al. | 70/DIG. 62 |
| 4,848,115 | 7/1989 | Clarkson et al. | 70/283 |
| 4,982,587 | 1/1991 | Tzou | 70/283 |
| 5,132,661 | 7/1992 | Pinnow | 70/277 |

FOREIGN PATENT DOCUMENTS

| | | | |
|---|---|---|---|
| 2645575 | 10/1990 | France | 70/276 |
| 2199881 | 7/1988 | United Kingdom | 70/283 |

*Primary Examiner*—Barnell M. Boucher
*Attorney, Agent, or Firm*—Hill, Steadman & Simpson

[57] ABSTRACT

A cylindrical barrel type lock wherein rotation of the barrel is prevented by one or more armatures which are actuated by an electromagnet. Energization of the electromagnet causes the armatures to be withdrawn from engagement with the barrel, thereby permitting its rotation to open the lock.

22 Claims, 2 Drawing Sheets

ELECTROMAGNETIC LOCK FOR CYLINDRICAL LOCK BARREL

This application is a continuation of U.S. application Ser. No. 08/014,971 filed Feb. 8, 1993, now abandoned.

BACKGROUND OF THE INVENTION

1. Field of the Invention

This invention relates to locks wherein a cylindrical barrel is prevented from turning, thereby permitting opening of the lock, by electromagnetically actuated armatures which engage the barrel to prevent its turning in the body of the lock. An electronic circuit associated with the lock provides for the energization of an electromagnet which withdraws the armatures from contact with the barrel thereby permitting its rotating to open the lock. A key received in a slot in the barrel of the lock is coded, for instance, magnetically or optically, such that if it bears a predetermined code, the electronic circuit will respond to the code to energize the electromagnet to permit rotation of the barrel to open of the lock.

2. Description of Related Art Including Information Disclosed under Secs. 1.97–1.99

In locks of the type set forth above, the armatures were located such that it has been possible to break a portion of the barrel, by inserting an instrument through the key slot, such that the barrel may be rotated to open the lock even though the electromagnet has not been energized to withdraw the armatures from engagement with the barrel. That is, by breaking away a portion of the barrel, it is possible to insert an instrument through the key slot into engagement with the armature to move the armature out of engagement with the barrel so as to permit rotation of the barrel.

SUMMARY OF THE INVENTION

Accordingly, it is an object of this invention to provide a cylindrical type lock wherein the cylindrical barrel is prevented from rotation by engagement with one or more armatures actuated by an electromagnet. It is a further object of this invention to provide a cylindrical lock with an electromagnetically actuated armature which is not readily defeated by breaking away a portion of the lock barrel.

In accordance with this invention, a cylindrical barrel type lock is provided in which one or more armatures engage one or more notches in the barrel to prevent its rotation. The notches in the barrel are sufficiently separated from the slot provided for receiving a key so as to prevent a portion of the barrel being easily broken away such that the armatures may be removed from engagement with the barrel so as to permit rotation of the barrel.

DETAILED DESCRIPTION OF THE PREFERRED EMBODIMENT

Figure 1:
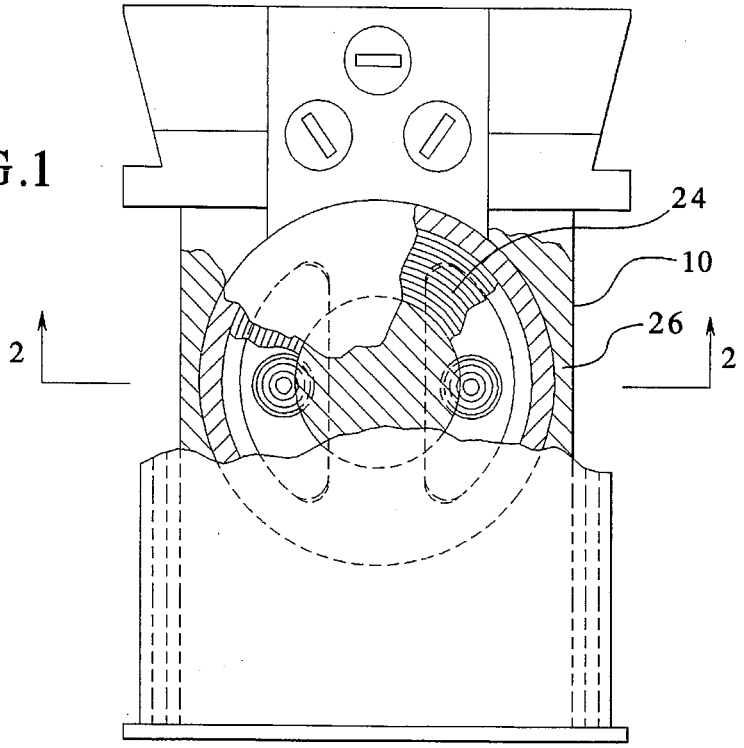
FIG. 1 is a top plan view of an electronically actuated cylindrical lock provided with improved electromagnetically actuated armatures in accordance with this invention.

Referring to FIGS. 1–4, a cylindrical barrel type lock incorporating the electromagnetically actuated armatures of this invention will be described. The lock includes an outer shell or body member 10 which has a cylindrical bore 12 therein for receiving a cylindrical lock barrel 14. The cylindrical lock barrel is provided with a slot 16 for receiving a key (not shown) which is used to unlock the lock, i.e. permit rotation of the barrel 14 with respect to the body member 10. The manner in which the lock is unlocked by a key will be hereinafter described.

The body member 10 is provided with a cavity 18 for receiving an electromagnet 20. As shown, the electromagnet and the cavity 18 both have a cylindrical cross-section. The electromagnet includes a central magnetic core 22, surrounded by a multi-turn coil 24, which is in turn surrounded by a cylindrical magnetic jacket 26. A circular member 28 formed of a magnetic material covers the top of the coil 24 and abuts an end of the core 22, and a portion of the inside edge of the jacket 26. An outer cover 30 is placed over the cover 28 and engages the walls of the cavity 18 to close the open end of the cavity.

Figure 2:
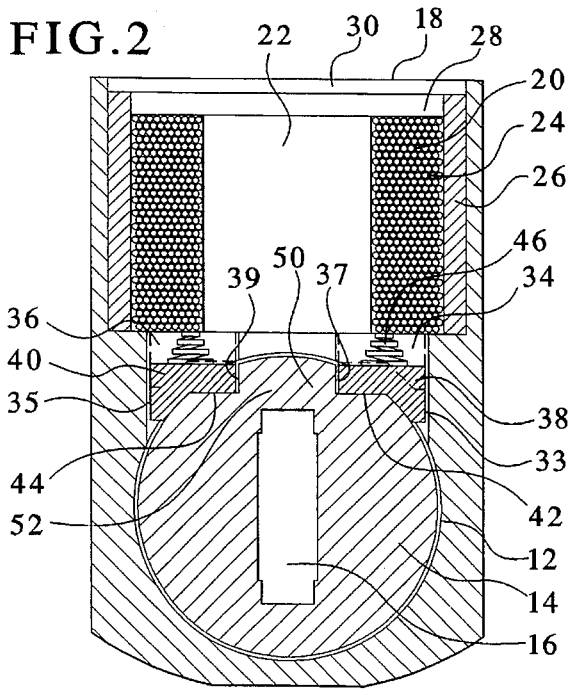
FIG. 2 is a cross-sectional view taken along the line 2—2 in FIG. 1 showing the improved electromagnetically actuated armatures of this invention.
Figure 3:
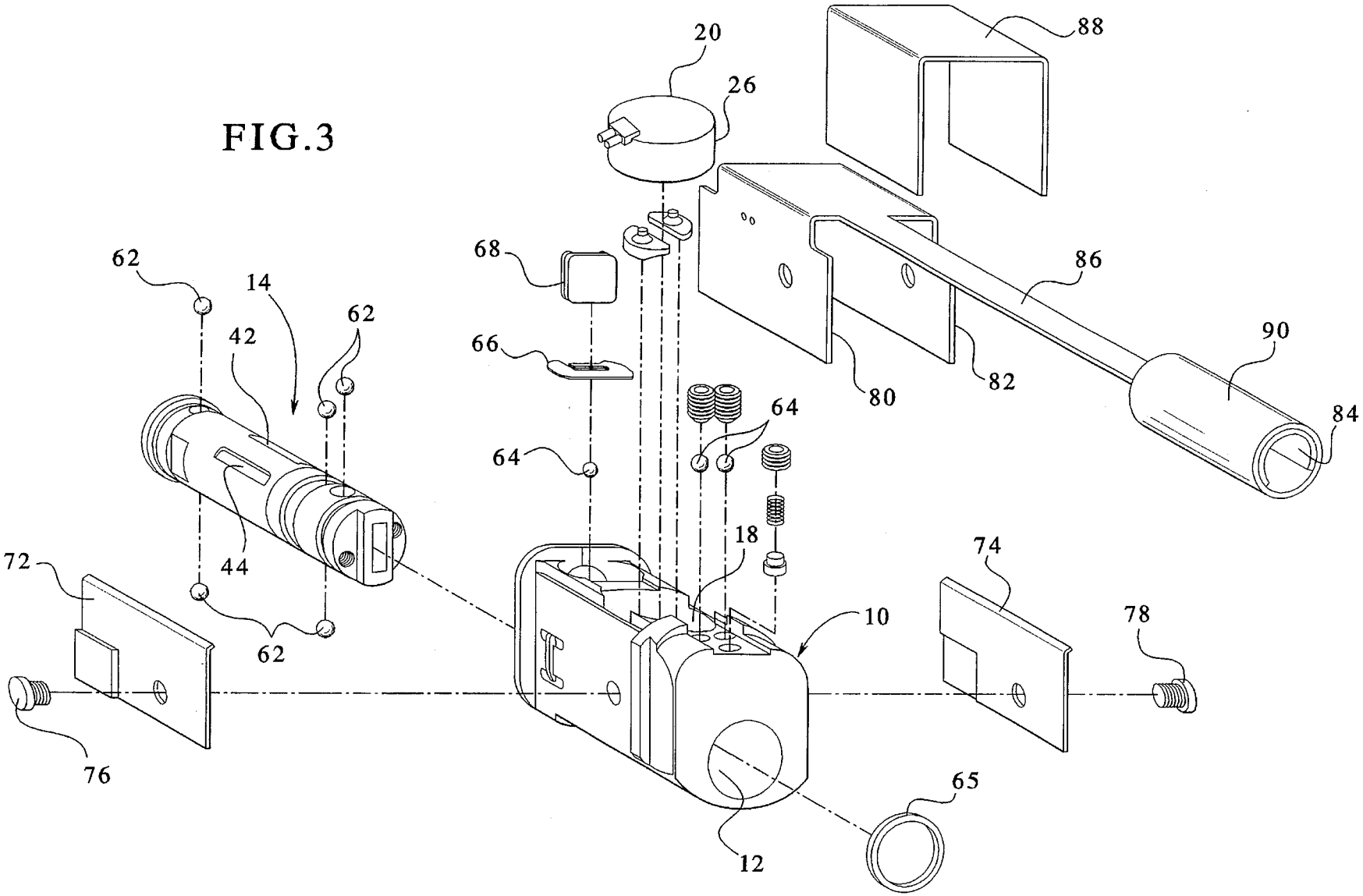
FIG. 3 is an exploded perspective view, on a reduced scale, of the electromagnetically actuated cylindrical lock shown in FIG. 1.

Extending from the base of cavity 18 to the bore 12 are a pair of cavities 34 and 36. As seen in FIGS. 1 and 3, the cavities 34 and 36 have a cross-sectional shape which is generally that of a segment. A pair of armatures 38 and 40 having the same cross-sectional shape are received in the cavities 34 and 36. Referring to FIG. 1, the cavities 34 and 36 and the armatures 38 and 40 respectively have sides 33 and 35 in the form of a portion of a cylinder, and sides 37 and 39 which are planar respectively. As shown in FIG. 2, the lock barrel 14 has a pair of notches 42 and 44 formed in its outer surface, which are positioned with respect to each other such that when the lock barrel 14 is in the position shown in FIG. 2, the armatures 38 and 40 will be received in the notches to prevent rotation of the barrel 14. The notches 42 and 44 are formed on opposite sides of the diameter of the barrel 14 which is the central axis of the key slot and are spaced apart at a greater distance than the width of the key slot.

Conical springs 46 and 48 are positioned between the armatures 38 and 40 respectively and the lower surface of the electromagnet 20, to urge the armatures into engagement with the notches 42 and 44. However, if the installation of the lock is such that the body member will always be installed in the position shown in FIG. 2, then the springs would not be necessary, since the force of gravity will cause the armatures 38 and 40 to fall into the notches 42 and 44.

Figure 4:
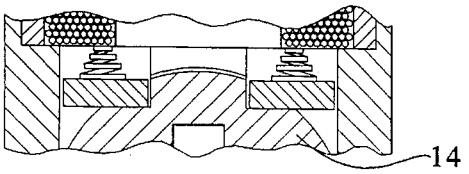
FIG. 4 is a partial cross-sectional view corresponding to FIG. 2, showing an alternative cross-sectional shape of the armatures of this invention.

As shown in FIG. 2, each of the lower surface of armatures 38 and 40 has a flat portion which engages one of the planar surfaces of the notches 42 and 44 respectively, and a curved portion which engages the curved outer surface of the barrel 14. While this form of the bottom surface has been found to have some advantages, a flat bottom surface on the armatures as shown in FIG. 4 has also been found to perform satisfactorily.

The electromagnet when energized asserts an attractive force on the pair of armatures 38 and 40 which are formed of a magnetic material, to overcome the forces of the springs 46 and 48, and lift the bottom surface of the armatures above the cylindrical surface of the bore 12, whereby the barrel 14 may be rotated by turning the key to unlock the lock.

Referring again to FIG. 2, it will be seen that if an attempt is made to rotate the barrel 14 in a clockwise direction, with the armature 38 engaged in the notch 42, the planar surfaces 37 and the cylindrical surfaces 33 of armature 38 and notch 42 and the cylindrical sidewall of the cavity 34 will be engaged to positively stop such rotation. Similarly, attempted rotation in the counter-clockwise direction with the armature 40 engaged in the notch 44, will cause the planar surfaces 39 and the cylindrical surfaces 35 of the armature 40 and notch 44 and the cylindrical sidewall of the cavity 36 to be engaged to positively stop such rotation. It should be apparent that these engagements are perpendicular to the direction of the forces of the springs 46 and 48, such that if they are utilized, the amount of force applied in attempting to turn the barrel, or any vector portion of it is not in a direction to attempt to lift the armatures 38 and 40. In other words, in an attempt to rotate the core or barrel 14 by a clockwise torque, the armature 38 is laterally compressed between opposing faces of the notch 42 and the cavity 34, preventing rotation of the barrel 14. Likewise, if a counter-clockwise torque is exerted on the core or barrel 14, the armature 40 is laterally compressed between opposing faces of the notch 44 and the cavity 36, preventing rotation of the barrel 14.

Figure 5:
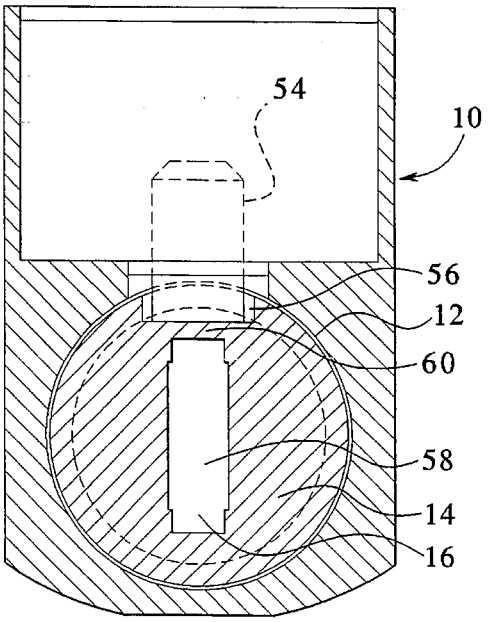
FIG.5 (PRIOR ART)
FIG. 5 is a cross-sectional view corresponding to FIG. 2 showing a prior art electromagnetically actuated armature for a cylindrical lock.

It should be noted that considerable barrel material exists at 50 and 52, the closest spaces between the notches 42 and 44 and the key slot 16. Thus, it would be quite difficult to break this material with any instrument which could be inserted through the key slot 16. This is in contradistinction to a prior art design of a similar lock as shown in FIG. 5. Referring to FIG. 5, a single armature 54 is positioned to be engaged in a single notch 56. It should be noted that the notch 56 is located directly above the key slot 58. When this prior design has been used, the lock has been defeated by inserting an instrument through the slot 58 to break the thin web 60 of material separating the top of the slot from the base of the notch 56. With the web 60 broken away, the same or a different instrument may be used to lift the armature 54 to permit the barrel of the lock to be turned.

Referring to FIG. 3, wherein corresponding numerals are used to identify corresponding components shown in FIGS. 1, 2 and 4, the assembly of a lock incorporating this invention will be described. Prior to inserting the barrel 14 in the bore 12, a number of ball bearings 62 are positioned in recesses form in the barrel. These ball bearings as well as similar ball bearings 64 placed in recesses in the body member 14, serve to accurately position the barrel 14 in the bore 12 and, in certain cases, to prevent clockwise or counter-clockwise rotation of the barrel 14 in the bore 12. The lock barrel 14 is inserted into the bore 12 of the body member 14 and retained therein by a retaining ring 65. After the ball bearings 64 are placed in the recesses in the body member 14, and the switch spring 66, lens retainer 68, armatures 38 and 40, springs 46 and 48, and electromagnet 20 assembled to the body member 14, a printed circuit board 70 is placed over the body member 14 and secured thereto by retainers 72 and 74 and screw fasteners 76 and 78.

Printed circuit board 70 is formed with two wings 80 and 82 which wrap around opposite sides of the body member 14. One of the wings is provided with light emitting devices, such as light emitting diodes, and the other side with aligned light sensitive switching devices. The light emitting devices, and the light sensitive switching devices are aligned with light transparent paths through the body member 14 and the barrel 14, such that when a key, having appropriate predetermined light transparent portions, is inserted in the slot 16, the light sensitive switching devices will be activated to energize the electromagnet through a control circuit to permit the barrel 14 to be turned to open the lock. Connections to the control circuit are made through contacts provided at terminal end 84 of the printed circuit conductors 86 extending from the printed circuit board 70. The printed circuit 70 is protected by a cover 88, and the contacts at the terminal end 84 by cover 90 prior to installation of the lock.

Thus, in accordance with this invention, a cylindrical lock is provided wherein the barrel may be locked by electromagnetic armatures placed in positions which makes the breaking of the barrel to defeat the lock most difficult. While in accordance with this invention, a pair of locking armatures are provided, it is contemplated that in accordance with the invention, only a single armature could be provided or even greater number of armatures and of electromagnets.

It should be apparent to those skilled in the art that what has been described is considered at present to be a preferred embodiment of the electromagnetically actuated armature lock for a cylindrical lock barrel. In accordance with the Patent Statutes, changes may be made in the electromagnetically actuated armature barrel locks as shown and described, without actually departing from the true spirit and scope of this invention. The appended claims are intended to cover all such changes and modifications which fall in the true spirit and scope of this invention.

I claim:

1. A cylindrical lock including an outer shell having a cylindrical bore therein for receiving for rotation therein a cylindrical barrel having a cylindrical outer surface, said cylindrical barrel having an axially extending slot formed therein for receiving a key to unlock and rotate said cylindrical barrel in said cylindrical bore, a major axis of a cross-section of said slot coinciding with a diameter of said cylindrical barrel, said outer shell having a first cavity formed therein for receiving an electromagnet, the central axis of said first cavity being in alignment with a diameter of said cylindrical bore, at least a second cavity extending from said first cavity to said cylindrical bore, the central axis of said second cavity being offset from and parallel to the center axis of said first cavity, said barrel having at least one notch formed in said outer surface, which notch is offset from said diameter of said cylindrical barrel which coincides with the major axis of the cross-section of said slot and may be positioned in alignment with said second cavity, an armature receiving in said second cavity, a portion of said armature in a first position extending from said second cavity into said at least one notch in said barrel to thereby prevent rotation of said barrel in said cylindrical bore, energization of said electromagnet being effective to move said armature to a second position wherein said portion of said armature is retracted from said notch in said barrel, whereby said barrel is free to rotate in said cylindrical bore, said second cavity, said notch and said armature being arranged such that said armature is subjected to compression forces in said first position upon rotation of said barrel.

2. The cylindrical lock of claim 1, wherein said second cavity and said armature have the same cross-sectional shape.

3. The cylindrical lock of claim 2, wherein said cross-sectional shape is longer in the direction of the major axis of said bore than in the direction perpendicular to the major axis of said bore.

4. The cylindrical lock of claim 1, wherein a force providing means urges said armature into said first position, and energization of said electromagnet is effective to overcome the force provided by said force providing means to move said armature to said second position wherein said portion of said armature is retracted from said notch in said barrel.

5. The cylindrical lock of claim 4, wherein said force providing means is a spring.

6. The cylindrical lock of claim 4, wherein said force providing means is a conical spring.

7. The cylindrical lock of claim 1, wherein said notch is formed by two planar sides at right angles to each other, one of said sides being parallel to and spaced from a plane which passes through said diameter of said cylindrical barrel which coincides with the major axis of the cross-section of said slot.

8. The cylindrical lock of claim 7, wherein said armature is provided with two planar sides at right angles to each other, which engage said two planar side of said notch when said armature is extended into said notch.

9. The cylindrical lock of claim 1, wherein said armature is provided with a surface which engages a portion of the cylindrical surface of said barrel when said armature extends into said notch.

10. The cylindrical lock of claim 1, wherein two second cavities extend from said first cavity to said cylindrical bore, said second cavities being offset on opposite sides from said diameter of said cylindrical barrel which coincides with the major axis of the cross-section of said slot, said barrel having two notches formed in said outer surface which may be positioned in alignment with said two second cavities, two armatures, one received in each of said second cavities, a portion of each of said armatures in first positioned extending from said second cavities into one of said notches in said barrel to thereby prevent rotation of said barrel in said cylindrical bore, energization of said electromagnet effective to move said armatures to second positions wherein said portions of said armatures are retracted from said notches in said barrel, whereby said barrel is free to rotate in said cylindrical bore, said second cavities, said notches and said armatures being arranged such that at least one of said armatures is subjected to compression forces in said first position upon rotation of said barrel.

11. The cylindrical lock of claim 10, wherein said second cavities and said armatures have the same cross-sectional shape.

12. The cylindrical lock of claim 11, wherein said cross-sectional shapes are longer in the direction of the major axis of said bore than in the direction perpendicular to the major axis of said bore.

13. The cylindrical lock of claim 10, including a pair of force providing means, one of said force providing means urging one of said armatures and the other of said force providing means urging the other of said armatures into said first positions, and energization of said electromagnet being effective to overcome the forces provided by said force providing means to move said armatures to said second positions wherein said portions of said armatures are retracted from said notches in said barrel.

14. The cylindrical lock of claim 13, wherein said force providing means are springs.

15. The cylindrical lock of claim 13, wherein said force providing means are helical springs.

16. The cylindrical lock of claim 10, wherein said notches are each formed by two planar sides at right angles to each other, one of said sides being parallel to and spaced from a plane which passes through said diameter of said cylindrical barrel which coincides with the major axis of the cross-section of said slot.

17. The cylindrical lock of claim 16, wherein each of said armatures is provided with two planar sides at right angles to each other, which engage said two planar sides of one of said notches when said armatures is extended into said notch.

18. A lock comprising:

a cylinder;

a core rotatably received within a bore in said cylinder;

at least one armature movable between a first position which prevents said core from rotating relative to said cylinder and a second position which allows said core to rotate relative to said cylinder; and a magnetic device operatively associated with said at least one armature to move said at least one armature between said first and second positions;

said cylinder including a cavity in which said at least one armature is received in both said first and second positions;

said core having a notch in which said at least one armature is received in said first position, said cavity, notch and armature being configured such that said at least one armature is subjected to compression forces by opposed faces in said cavity and said notch while in said first position upon rotation of said core.

19. The lock of claim 18, wherein in cross section said core and cylinder have coincident vertical and horizontal axes,and said cavity is configured such that along a line parallel to said horizontal axes at a bottom wall of said notch, said cavity extends horizontally into said cylinder.

20. A lock comprising:

a cylinder;

a core rotatably received within a bore in said cylinder;

at least two armatures movable parallel to each other between a first position which prevents said core from rotating relative to said cylinder and a second position which allows said core to rotate relative to said cylinder; and at least one magnetic device operatively associated with said at least two armatures to move said armatures between said first and second positions;

said cylinder including corresponding cavities in which said armatures are received in both said first and second positions;

said core having at least two notches corresponding to said at least two armatures and in which said armatures are engaged in said first position, said cavities, notches and armatures being configured such that when in said first position, one of said armatures is laterally compressed between opposed faces of the associated cavity and notch upon application of torque to the core in one rotational direction, and such that the other armature is laterally compressed between a opposed face of its respective notch and cavity upon application of torque to the core in an opposite rotational direction.

21. The lock of claim 20, wherein in cross section said core and cylinder have coincident vertical and horizontal axes, and said cavities are positioned on opposite sides of said vertical axis and configured such that along a line parallel to said horizontal axes at bottom walls of said notches, said cavities extend horizontally into said cylinder.

22. A lock comprising:

a cylinder having a bore;

a barrel rotatably received in the cylinder bore;

a pair of notches formed in an outer circumference of the barrel, the notches being spaced circumferentially from each other;

a pair of cavities formed in the cylinder, each cavity aligning with a respective notch when the core is rotated to predetermined position;

a pair of armatures, each armature being received within one of the cavities, the armatures being moveable in a parallel manner between first and second positions, each armature being laterally compressed between a wall of the respective notch and an opposing wall of the corresponding cavity when in the first position to prevent rotation of the barrel, the armatures being retracted from the notches and positioned only within the cavities when in the second position; and a magnetic device operative to move the armatures between the first and second positions.

* * * * *